US011737181B2

(12) United States Patent
Kim

(10) Patent No.: US 11,737,181 B2
(45) Date of Patent: Aug. 22, 2023

(54) APPARATUS FOR CONTROLLING LAMP AND METHOD THEREOF

(71) Applicant: HYUNDAI MOBIS CO., LTD., Seoul (KR)

(72) Inventor: Myeong Je Kim, Yongin-si (KR)

(73) Assignee: HYUNDAI MOBIS CO., LTD., Seoul (KR)

( * ) Notice: Subject to any disclaimer, the term of this patent is extended or adjusted under 35 U.S.C. 154(b) by 0 days.

(21) Appl. No.: 17/539,393

(22) Filed: Dec. 1, 2021

(65) Prior Publication Data

US 2022/0201816 A1 Jun. 23, 2022

(30) Foreign Application Priority Data

Dec. 23, 2020 (KR) ..... 10-2020-0182474
Dec. 23, 2020 (KR) ..... 10-2020-0182475

(51) Int. Cl.
*H05B 45/14* (2020.01)
*F21S 41/141* (2018.01)
*H05B 45/18* (2020.01)
*F21Y 115/10* (2016.01)

(52) U.S. Cl.
CPC ..... *H05B 45/14* (2020.01); *F21S 41/141* (2018.01); *H05B 45/18* (2020.01); *F21Y 2115/10* (2016.08)

(58) Field of Classification Search
CPC ..... H05B 45/14; H05B 45/18; H05B 45/20; H05B 45/28; H05B 45/42; H05B 45/56; H05B 45/325; H05B 47/28; H05B 47/135
See application file for complete search history.

(56) References Cited

U.S. PATENT DOCUMENTS

2009/0009102 A1* 1/2009 Kahlman ..... H05B 45/42 315/250
2010/0219758 A1* 9/2010 Melzner ..... F21V 31/04 315/297
2012/0032612 A1* 2/2012 Antony ..... H05B 45/56 315/297
2013/0120690 A1* 5/2013 Tsujii ..... G01R 31/67 315/192
2013/0193851 A1* 8/2013 Alon ..... H05B 45/46 315/121
2014/0268737 A1* 9/2014 Athalye ..... F21V 13/04 362/235
2015/0102748 A1* 4/2015 Lee ..... G02F 1/133609 315/297
2017/0231053 A1* 8/2017 Underwood ..... H02J 7/35
2018/0063907 A1* 3/2018 Kambara ..... H02M 3/33507
2021/0127468 A1* 4/2021 Li ..... H05B 45/54

* cited by examiner

*Primary Examiner* — Tung X Le
(74) *Attorney, Agent, or Firm* — NovoTechIP International PLLC

(57) ABSTRACT

Disclosed are apparatus for controlling a lamp and a method thereof. The apparatus for controlling a lamp includes an information collection device that receives light amount information and temperature information of LED chips, which correspond to a plurality of LED boards, respectively, from the plurality of LED boards through one port, and a controller that controls a driving current for driving the LED chip based on the light amount information of the LED chip or the temperature information of the LED chip.

15 Claims, 13 Drawing Sheets

(b)

(a)

| MCU Pin map | | | | | | | | | |
|---|---|---|---|---|---|---|---|---|---|
| | Port number | Pin number | IO type | State | PU/PD | Driving Voltage | Driving Current | Function | 2019.12.09 (Assignment) |
| Port 2 | P2.2 | 33 | I | I | | ~5.5V | 10mA | AN2 | Comp |
| Port 2 | P2.6 | 34 | I | I | | ~5.5V | 10mA | AN6 | BIN2/NTC2 |
| Port 2 | P2.7 | 35 | I | I | | ~5.5V | 10mA | AN7 | BIN1/NTC1 |
| Port 2 | P2.3 | 36 | I | I | | ~5.5V | 10mA | AN3 | BIN3/NTC3 |
| Port 2 | P2.1 | 37 | I | I | | ~5.5V | 10mA | AN1 | VLED_mon |
| Port 2 | P2.0 | 39 | I | I | | ~5.5V | 10mA | AN0 | LEDCURR |

FIG.12

APPARATUS FOR CONTROLLING LAMP AND METHOD THEREOF

CROSS-REFERENCE TO RELATED APPLICATION

This application claims the benefit of priority to Korean Patent Application No. 10-2020-0182474, filed in the Korean Intellectual Property Office on Dec. 23, 2020 and Korean Patent Application No. 10-2020-0182475, filed in the Korean Intellectual Property Office on Dec. 23, 2020, the entire contents of which are incorporated herein by reference.

TECHNICAL FIELD

The present disclosure relates to an apparatus for controlling a lamp and a method thereof.

BACKGROUND

Various lamps necessary for driving are installed in a vehicle. For example, there are low and high beam lamps serving as a head lamp for securing forward visibility during night driving, a daytime running light (DRL) lamp serving as daytime headlamp, a position lamp serving as a sidelight, a static bending light (SBL) lamp serving as a smart cornering lamp, a turn lamp serving as a turn indicator light, and the like.

Such a lamp may include a plurality of LEDs. Because the amount of light is different for each LED, each LED unit must be controlled through an LED drive module to output the same amount of light. In addition, because the amount of light decreases as the temperature increases, LEDs must be controlled by monitoring the temperature.

In general, one LED control board receives light amount information and temperature information of one LED.

In order to receive the temperature information through an NTC sensor and the light amount information through a BIN resistance for each LED board, the pins are allocated to a microcomputer (MICOM), so that the number of the pins is insufficient.

Therefore, in order to increase the number of pins of the MICOM, a product with a larger package must be used, which increases the manufacturing cost.

SUMMARY

The present disclosure has been made to solve the above-mentioned problems occurring in the prior art while advantages achieved by the prior art are maintained intact.

An aspect of the present disclosure provides an apparatus for controlling a lamp and a method thereof which can receive a plurality of BIN resistance data providing information on an amount of light of an LED through one input pin of an MCU, and receive a plurality of NTC sensor data providing temperature information of the LED through another input pin of the MCU, thereby reducing the manufacturing cost.

The technical problems to be solved by the present disclosure are not limited to the aforementioned problems, and any other technical problems not mentioned herein will be clearly understood from the following description by those skilled in the art to which the present disclosure pertains.

According to an aspect of the present disclosure, an apparatus for controlling a lamp includes an information collection device that receives light amount information and temperature information of LED chips, which correspond to a plurality of LED boards, respectively, from the plurality of LED boards through one port, and a controller that controls a driving current for driving the LED chip based on the light amount information of the LED chip or the temperature information of the LED chip.

According to an embodiment, the information collection device may sequentially receive the light amount information of the plurality of LED chips by sharing one port of a micro controller unit (MCU), and sequentially receive the temperature information of a plurality of LED chips by sharing another port of the micro controller unit (MCU).

According to an embodiment, the light amount information may include a voltage value across both ends of a BIN resistor included in each of the plurality of LED boards, and the controller may calculate a resistance value of the BIN resistor by using the voltage value and identify a light amount of the LED chip to control the driving current.

According to an embodiment, the controller may calculate the resistance value of the BIN resistor by acquiring the voltage value at both ends of the BIN resistor included in each of the plurality of LED boards once.

According to an embodiment, the temperature information may include a voltage value across both ends of a thermal resistor included in each of the plurality of LED boards, and the controller may calculate a resistance value of the thermal resistor by using the voltage value and identify a temperature of the LED chip to control the driving current.

According to an embodiment, the thermal resistor may include an NTC thermistor whose resistance decreases when an ambient temperature rises.

According to an embodiment, the controller may alternately and repeatedly monitor the voltage value across both ends of the thermal resistor included in each of the plurality of LED boards, and identify the temperature of the LED chip to control the driving current when the temperature of the LED chip attains or exceeds a specified threshold value.

According to an embodiment, the controller may obtain the voltage value output after a specified stabilization time has lapsed when monitoring the voltage value across both ends of the thermal resistor included in each of the plurality of LED boards.

According to an embodiment, the controller may shorten a monitoring period of the thermal resistor when the temperature of the LED chip closely approaches a specified threshold value when monitoring the voltage value across both ends of the thermal resistor included in each of the plurality of LED boards.

According to another aspect of the present disclosure, a method of controlling a lamp includes receiving light amount information and temperature information of LED chips, which correspond to a plurality of LED boards, respectively, from the plurality of LED boards through one port, and controlling a driving current for driving the LED chip based on the light amount information of the LED chip or the temperature information of the LED chip.

According to an embodiment, the receiving of the light amount information and the temperature information may include sequentially receiving the light amount information of the plurality of LED chips by sharing one port of a micro controller unit (MCU), and sequentially receiving the temperature information of a plurality of LED chips by sharing another port of the micro controller unit (MCU).

According to an embodiment, the controlling of the driving current may include controlling the driving current by identifying a light amount of the LED chip after calculating a resistance value of a BIN resistor by using the voltage value across both ends of the BIN resistor included in each of the plurality of LED boards.

According to an embodiment, the controlling of the driving current may include calculating the resistance value of the BIN resistor by acquiring the voltage value at both ends of the BIN resistor included in each of the plurality of LED boards once.

According to an embodiment, the receiving of the light amount information and the temperature information of the LED chips may include controlling the driving current by identifying a temperature of the LED chip after calculating a resistance value of a thermal resistor by using a voltage value across both ends of the thermal resistor included in each of the plurality of LED boards.

According to an embodiment, the controlling of the driving current for driving the LED chip may include alternately and repeatedly monitoring the voltage value across both ends of the thermal resistor included in each of the plurality of LED boards, and identifying the temperature of the LED chip to control the driving current when the temperature of the LED chip attains or exceeds a specified threshold value.

According to an embodiment, the controlling of the driving current for driving the LED chip may include obtaining the voltage value output after a specified stabilization time has lapsed when monitoring the voltage value across both ends of the thermal resistor included in each of the plurality of LED boards.

According to an embodiment, the controlling of the driving current for driving the LED chip may include shortening a monitoring period of the thermal resistor when the temperature of the LED chip closely approaches a specified threshold value when monitoring the voltage value across both ends of the thermal resistor included in each of the plurality of LED boards.

BRIEF DESCRIPTION OF THE DRAWINGS

The above and other objects, features and advantages of the present disclosure will be more apparent from the following detailed description taken in conjunction with the accompanying drawings:

FIG. 12 is a view illustrating the use of pins of an MCU through an apparatus for controlling a lamp according to the second embodiment of the present disclosure.

DETAILED DESCRIPTION

Figure 1:
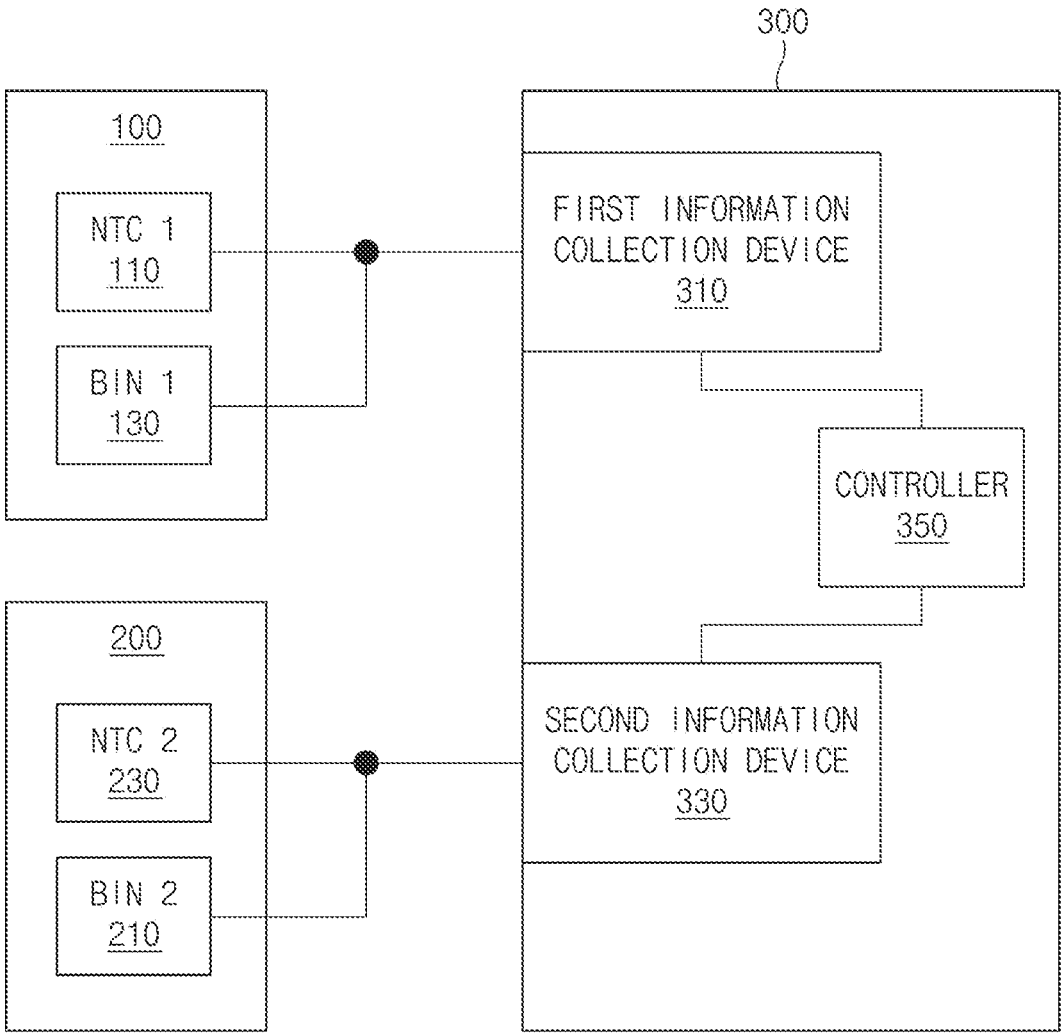
FIG. 1 is a block diagram illustrating an apparatus for controlling a lamp according to a first embodiment of the present disclosure.

Hereinafter, some embodiments of the present disclosure will be described in detail with reference to the exemplary drawings. In adding the reference numerals to the components of each drawing, it should be noted that the identical or equivalent component is designated by the identical numeral even when they are displayed on other drawings. Further, in describing the embodiment of the present disclosure, a detailed description of the related known configuration or function will be omitted when it is determined that it interferes with the understanding of the embodiment of the present disclosure.

In describing the components of the embodiment according to the present disclosure, terms such as first, second, A, B, (a), (b), and the like may be used. These terms are merely intended to distinguish the components from other components, and the terms do not limit the nature, order or sequence of the components. Unless otherwise defined, all terms including technical and scientific terms used herein have the same meaning as commonly understood by one of ordinary skill in the art to which this disclosure belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Hereinafter, embodiments of the present disclosure will be described in detail with reference to FIGS. 1 to 7.

FIG. 1 is a block diagram illustrating an apparatus for controlling a lamp according to a first embodiment of the present disclosure. FIGS. 2 to 7 are diagrams illustrating an operation process of an apparatus for controlling a lamp according to the first embodiment of the present disclosure.

Referring to FIG. 1, an apparatus for controlling a lamp according to the first embodiment of the present disclosure may include a first LED board 100, a second LED board 200, and an LED drive module 300.

The first LED board 100 may include an LED chip (not shown) serving as a light source, a first BIN resistor 110 and a first thermal resistor 130, and the second LED board 200 may also include an LED chip (not shown) as a light source, a second BIN resistor 210 and a second thermal resistor 230.

The first LED board 100 and the second LED board 200 may be mounted in plural on a headlamp (low beam lamp and high beam lamp) of a vehicle, a daytime running light (DRL) lamp serving as daytime headlamp, a position lamp serving as a sidelight, a static bending light (SBL) lamp serving as a smart cornering lamp, a turn lamp serving as a turn indicator light, and the like, but the embodiment is not limited thereto.

The first BIN resistor 110 and the second BIN resistor 210 may have resistance values corresponding to a flux BIN of the LED chip, and the LED drive module 300 may drive the LED chip to emit light at a light output power according to the flux BIN.

For reference, it is possible to take a sample of operating features and classify similar LEDs to suggest the cause of the change in the operating features of the LED due to the process change in manufacturing the LED. The flux BIN proposes a reference for classifying LEDs with similar features within an allowable range of light amount of the LEDs, that is, light output power.

For example, a specified reference flux BIN may be set for LEDs outputting 20 to 30 lumen flux at the same current, and another specified reference flux BIN may be set for LEDs outputting 30 to 40 lumen flux at the same current.

That is, the flux BIN may be defined as information for defining a current, voltage, and the like supplied to LEDs such that the LEDs have a specified light amount.

When the LED drive module 300 obtains the resistance value of the first BIN resistor 110 or the second BIN resistor 210, it is possible to know information about the light amount of an LED chip.

The first thermal resistor 130 and the second thermal resistor 230 may be elements whose resistance values vary according to the ambient temperature. For example, the first thermal resistor 130 and the second thermal resistor 230 may be NTC thermistors of which resistances decrease as the temperature of an LED chip rises.

When the temperature of the LED chip increases, the amount of light decreases, that is, deterioration may occur as the temperature increases.

Therefore, when the temperature of the LED chip attains or exceeds a specified threshold value through the resistance of the first thermal resistor 130 or the second thermal resistor 230, in order to lower the temperature below the specified threshold value, the LED drive module 300 may drive the LED chip while reducing the current.

The temperature of the LED chip may change frequently depending on the surrounding environment, and accordingly, the resistance value of the first thermal resistor 130 or the second thermal resistor 230 may be variably changed, so there may be a need to continuously monitor the resistance value of the first thermal resistor 130 or the second thermal resistor 230.

The LED drive module 300 may include a first information collection device 310, a second information collection device 330, and a controller 350.

The first information collection device 310 may be connected to the first BIN resistor 110 or the second BIN resistor 210 through one port to receive light amount information of the LED chip.

For example, the first information collection device 310 may share one analog to digital conversion (ADC) port of the micro controller unit (MCU) 300 to be sequentially connected to the first BIN resistor 110 or the second BIN resistor 210.

The second information collection device 330 may be connected to the first thermal resistor 130 or the second thermal resistor 230 through another port to receive the temperature information of the LED chip.

For example, the second information collection device 330 shares another ADC port of the MCU 300 to be sequentially connected to the first thermal resistor 130 or the second thermal resistor 230.

The controller 350 may control the driving current for driving the LED chip based on the light amount information of the LED chip or the temperature information of the LED chip.

Figure 2:
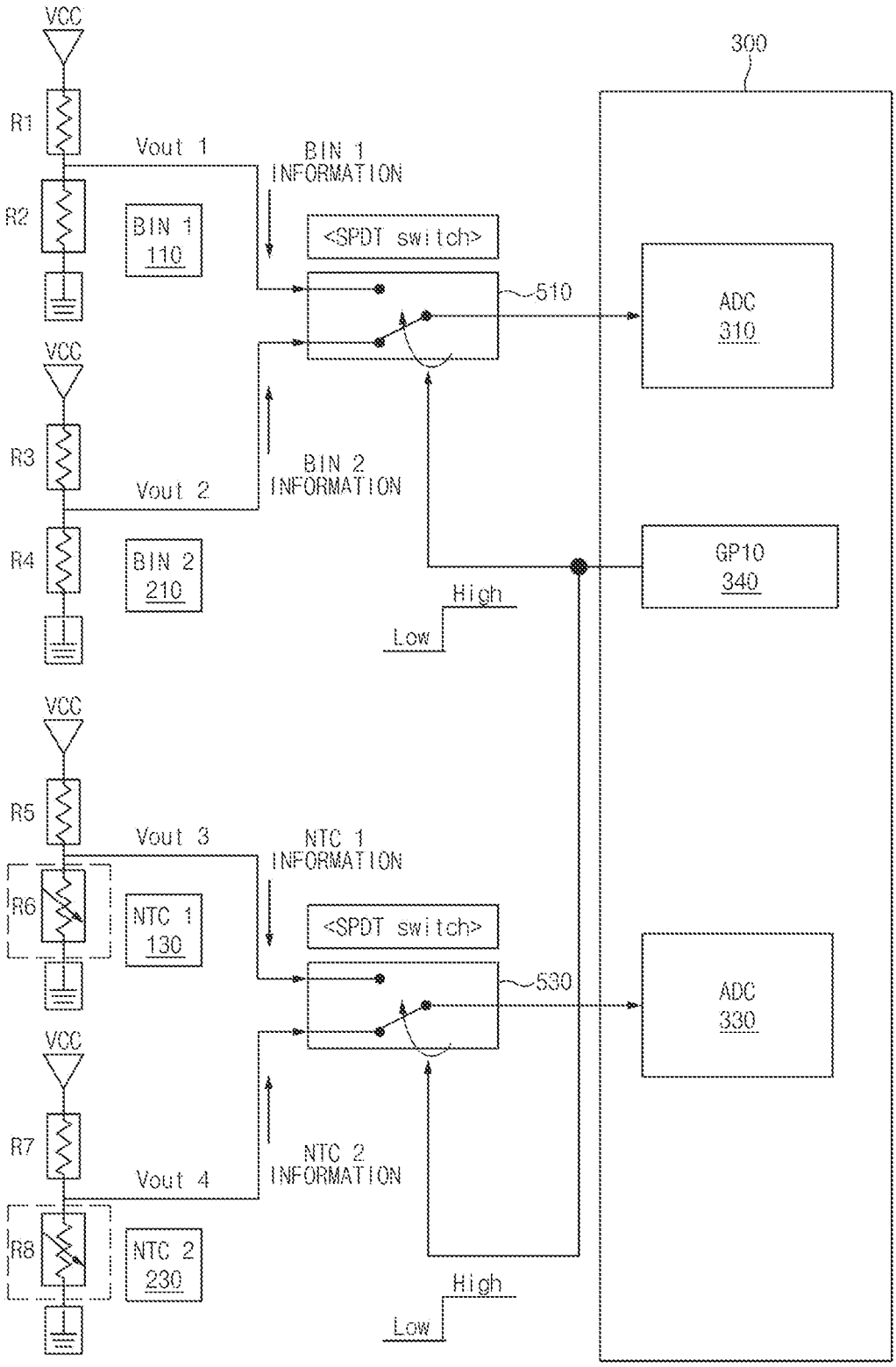
FIGS. 2 to 7 are diagrams illustrating an operation process of an apparatus for controlling a lamp according to the first embodiment of the present disclosure.

Referring to FIG. 2, shown are a circuit in which a first resistor R1 is connected between Vcc and Vout1 and a second resistor R2 is connected between Vout1 and the ground, and a circuit in which a third resistor R3 is connected between Vcc and Vout2 and a fourth resistor R4 is connected between Vout2 and the ground.

The first information collection device 310 may acquire Vout1 which is the voltage across the second resistor R2, or Vout2 which is the voltage across the fourth resistor R4.

$$Vout1 = \frac{R4}{R1 + R2} \times Vcc \quad \text{[Equation 1]}$$

-continued $$Vout2 = \frac{R4}{R3 + R4} \times Vcc \quad \text{[Equation 2]}$$

The first information collection device 310 may obtain the resistance value of the first BIN resistor 110 by calculating the resistance value of the second resistor R2 based on Equation 1 which is the voltage division law, and may obtain the resistance value of the second BIN resistor 210 by calculating the resistance value of the fourth resistor R4 based on Equation 2.

When the resistance value of the first BIN resistor 110 or the second BIN resistor 210 is relatively lower than a BIN resistance value providing information about a specified light amount, the current flowing through the LED chip is high, so that the amount of light greater than a specified amount of light may be output.

To the contrary, when the resistance value of the first BIN resistor 110 or the second BIN resistor 210 is relatively higher than the BIN resistance value providing information about a specified amount of light, the current flowing through the LED chip is low, so that the amount of light lower than the specified amount of light may be output.

A vehicle lamp, for example, a plurality of LED chips constituting a vehicle headlamp should output the same specified amount of light.

Therefore, in order for the plurality of LED chips to output the same specified amount of light, when the LED chip is in a state where an amount of light less than the specified amount of light is output corresponding to the resistance value of the first BIN resistor 110 or the second BIN resistor 210, the LED drive module 300 may drive the LED chip to output a specified amount of light by increasing the current.

In order for the plurality of LED chips to output the same specified amount of light, when the LED chip is in a state where an amount of light greater than the specified amount of light is output corresponding to the resistance value of the first BIN resistor 110 or the second BIN resistor 210, the LED drive module 300 may drive the LED chip to output a specified amount of light by decreasing the current.

The first information collection device 310 may be sequentially connected to the first BIN resistor 110 or the second BIN resistor 210 through a first single pole dual throw (SPDT) switch 510 having one output terminal and two input terminals.

The first BIN resistor 110 and the second BIN resistor 210 are respectively connected to the input terminal of the first SPDT switch 510, and the first information collection device 310 is connected to the output terminal of the first SPDT switch 510.

A separate switch drive device 340 may output a switch control signal (Low or High) to the first SPDT switch 510 to connect the input terminal of the first SPDT switch 510 to the first BIN resistor 110, thereby obtaining the resistance value of the first BIN resistor 110.

For example, the switch drive device 340 may be a general-purpose input/output (GPIO) of the MCU.

Then, the switch drive device 340 may output the switch control signal to the first SPDT switch 510 to connect the input terminal of the first SPDT switch 510 to the second BIN resistor 210, thereby obtaining the resistance value of the second BIN resistor 210.

Figure 3:
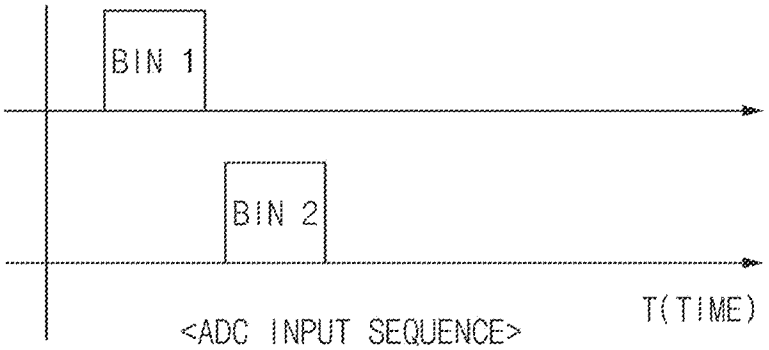
Figure 3:
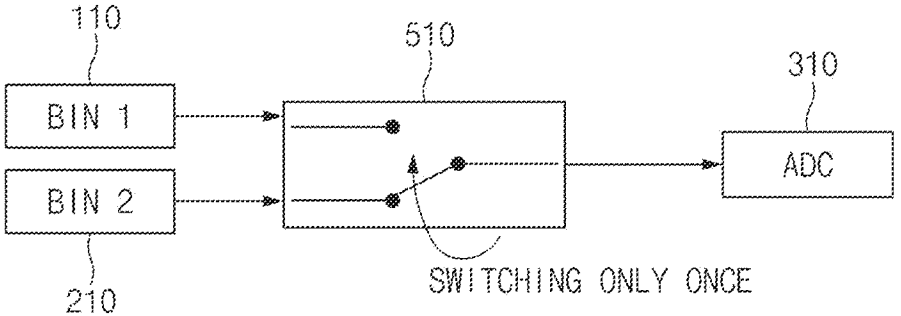

Referring to FIG. 3, when the resistance value of the first BIN resistor 110 is obtained only the first time after the LED chip is turned on according to the driving of the vehicle lamp, the controller 350 may drive the LED chip with the current corresponding to the resistance value of the first BIN resistor 110, so that the controller 350 is not connected to the first BIN resistor 110 thereafter.

When the resistance value of the second BIN resistor 210 is also obtained only the first time after the LED chip is turned on according to the driving of the vehicle lamp, the controller 350 may drive the LED chip with the current corresponding to the resistance value of the second BIN resistor 210, so that the controller 350 is not connected to the second BIN resistor 210 thereafter.

Accordingly, the LED drive module 300 may obtain information on the amount of light of the LED chip corresponding to the resistance value of the first BIN resistor 110 first measured once or the resistance value of the second BIN resistor 210 first measured once, and the controller 350 may drive the LED chip by changing the current such that a specified amount of light is output.

Referring to FIG. 2, shown are a circuit in which a fifth resistor R5 is connected between Vcc and Vout3 and a sixth resistor R6 is connected between Vout3 and the ground, and a circuit in which a seventh resistor R7 is connected between Vcc and Vout4 and an eighth resistor R8 is connected between Vout4 and the ground.

The second information collection device 330 may obtain Vout3 which is the voltage across the sixth resistor R6, or Vout4 which is the voltage across the eighth resistor R8.

$$Vout3 = \frac{R6}{R5 + R6} \times Vcc \quad \text{[Equation 3]}$$

$$Vout4 = \frac{R8}{R7 + R8} \times Vcc \quad \text{[Equation 4]}$$

Next, the second information collection device 330 may obtain the resistance value of the first thermal resistor 130 by calculating the resistance value of the sixth resistor R6 based on Equation 3 which is the voltage division law, and may obtain the resistance value of the second thermal resistor 230 by calculating the resistance value of the eighth resistor R8 based on Equation 4.

The LED drive module 300 may detect the temperature of the LED chip based on the resistance value of the first thermal resistor 130 or the second thermal resistor 230, and when the temperature attains or exceeds a specified threshold value, the controller 350 may drive the LED chip by changing the current such that a specified amount of light is output.

The second information collection device 330 may be sequentially connected to the first thermal resistor 130 or the second thermal resistor 230 connected through a second SPDT switch 530.

The first thermal resistor 130 and the second thermal resistor 230 may be respectively connected to the input terminal of the second SPDT switch 530, and the second information collection device 330 may be connected to the output terminal of the second SPDT switch 530.

The switch drive device 340 may output the switch control signal (Low or High) to the second SPDT switch 530 to connect the input terminal of the second SPDT switch 530 to the first thermal resistor 130, thereby obtaining the resistance value of the first thermal resistor 130.

Then, the switch drive device 340 may output the switch control signal (Low or High) to the second SPDT switch 530 to connect the input terminal of the second SPDT switch 530 to the second thermal resistor 230, thereby obtaining the resistance value of the second thermal resistor 230.

The LED drive module 300 may detect the temperature of the LED chip based on the resistance value of the first thermal resistor 130 or the second thermal resistor 230, and when the temperature attains or exceeds a specified threshold value, the controller 350 may drive the LED chip by changing the current such that a specified amount of light is output.

Figure 4:
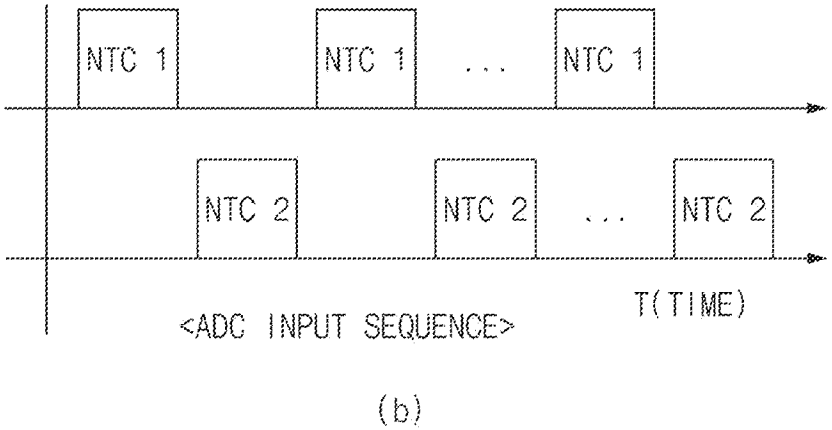
Figure 4:
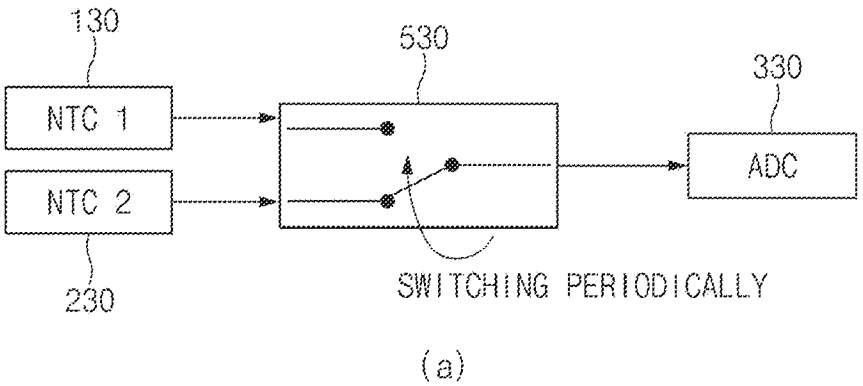

Referring to FIG. 4, because the temperature of the LED chip may change at any time depending on the surrounding environment, the measurement of the first thermal resistor 130 or the second thermal resistor 230 may be alternately repeated until the LED chip is turned off according to the extinguishment of the vehicle lamp after the LED chip is turned on according to the driving of the vehicle lamp.

That is, it may be repeatedly monitored whether the temperature of the LED chip attains or exceeds a specified threshold value by measuring the first thermal resistor 130 or the second thermal resistor 230. When the temperature of the LED chip attains or exceeds the specified threshold value, the controller 350 may drive the LED chip by changing the current at any time so that a specified amount of light is output.

Figure 5:
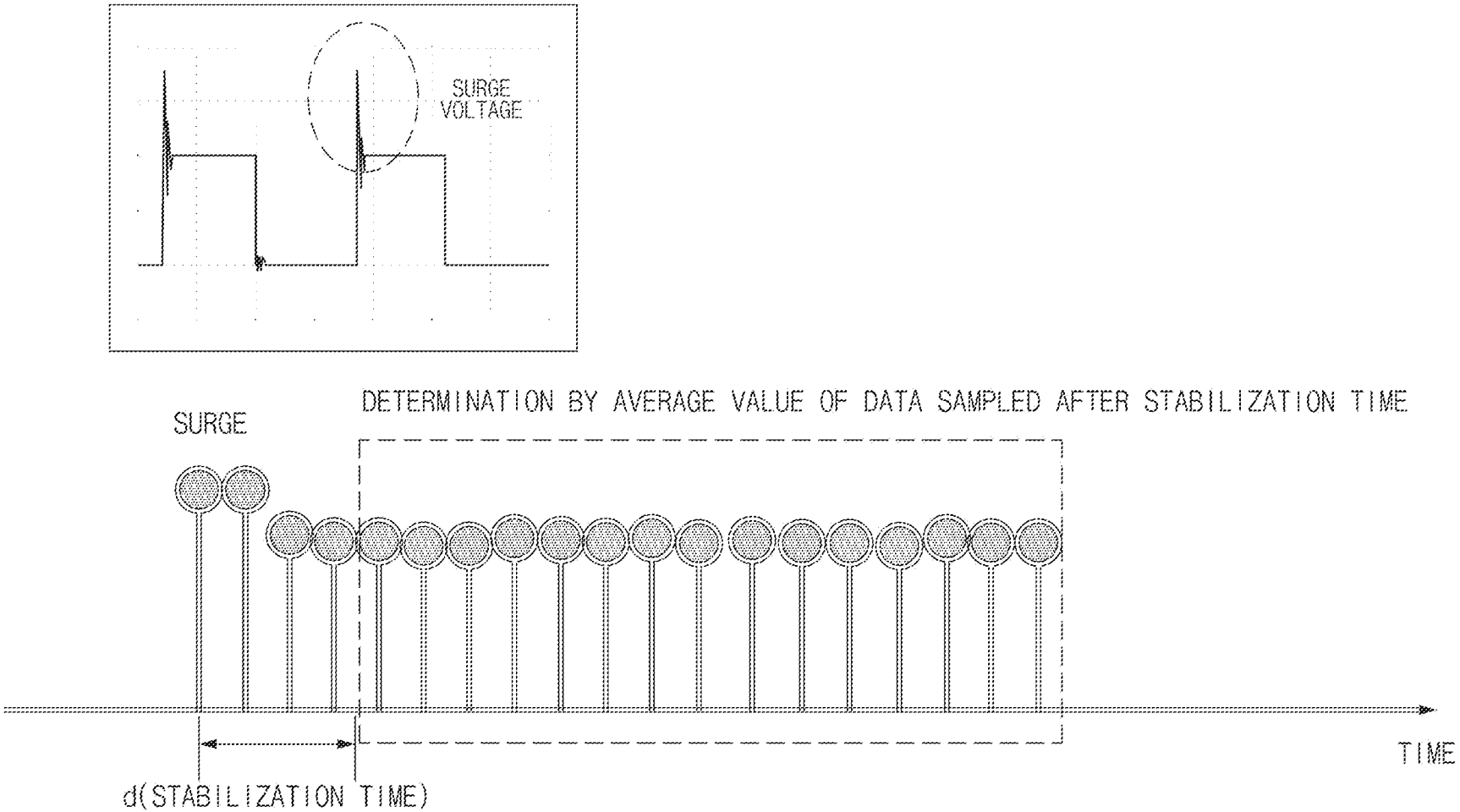

Referring to FIG. 5, due to the occurrence of a surge voltage while monitoring the temperature of the LED chip according to the resistance value of the first thermal resistor 130 or the second thermal resistor 230, an error may occur in the temperature measurement value of the LED chip.

Therefore, when a surge voltage is generated, after a specified stabilization time d, the measured value output after the stabilization time (d) may be sampled and averaged, and it may be used as a temperature value of the LED chip according to the resistance value of the first thermal resistor 130 or the second thermal resistor 230.

Figure 6:
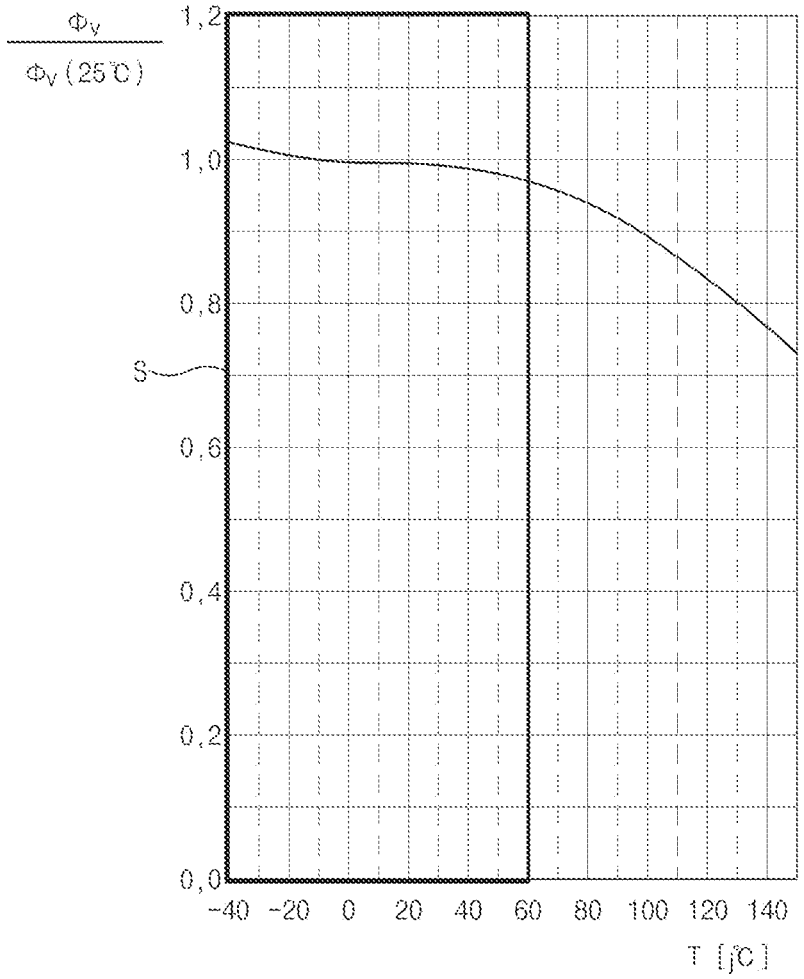
Figure 7:
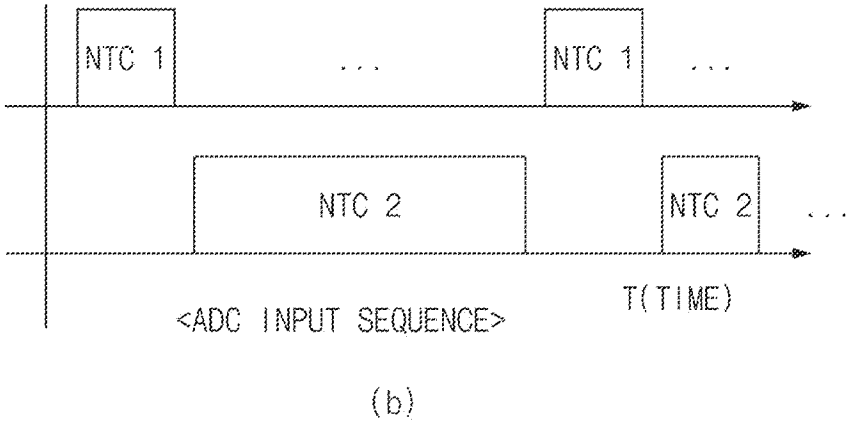
Figure 7:
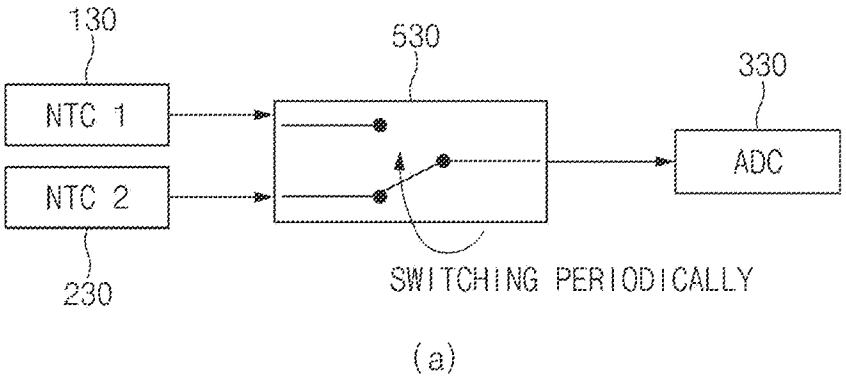

Referring to FIG. 6, because the LED chip does not deteriorate in a sleep section "S", which is a specified temperature range, there is no need to control the current according to the temperature.

Therefore, while repeating the temperature measurement of the LED chip according to the resistance value of the first thermal resistor 130 or the second thermal resistor 230, it is possible not to monitor the LED chip that is not turned on or has a relatively low temperature is not or to lengthen the monitoring cycle.

However, because deterioration may occur when the temperature attains or exceeds a specified temperature, that is, when the sleep section "S" is attained or exceeded, when the temperature of the LED chip approaches the boundary of the sleep section "S" or exceeds the sleep section "S", the monitoring cycle of the LED chip may be made relatively shorter.

For example, based on the boundary (60 degrees) of the slip section "S", when the temperature of the LED chip according to the measurement of the first thermal resistor 130 is measured to be less than 60 degrees, and when the temperature of the LED chip according to the measurement of the second thermal resistor 230 is measured to be 60 degrees or more, the monitoring cycle of the first thermal resistor 130 is relatively long, and the monitoring cycle of the second thermal resistor 230 can be relatively short.

Therefore, the monitoring of the second thermal resistor 230 rather than the first thermal resistor 130 may be performed preferentially.

As described above, without connecting the first BIN resistor 110, the second BIN resistor 210, the first thermal resistor 130 and the second thermal resistor 230 to each individual port of the LED drive module 300, the first BIN resistor 110 and the second BIN resistor 210 are sequentially connected by sharing one port, and the first thermal resistor 130 and the second thermal resistor 230 are sequentially connected by sharing another, so that the number of ports used may be reduced.

That is, although four ports are required to connect the first BIN resistor 110, the second BIN resistor 210, the first thermal resistor 130 and the second thermal resistor 230, the first BIN resistor 110 and the second BIN resistor 210 may be connected by sharing one port and the first thermal resistor 130 and the second thermal resistor 230 may be connected by sharing another port, so that it is possible to connect four elements with only two ports.

Hereinafter, a method of controlling a lamp according to a first embodiment of the present disclosure will be described in detail with reference to FIG. 8.

Figure 8:
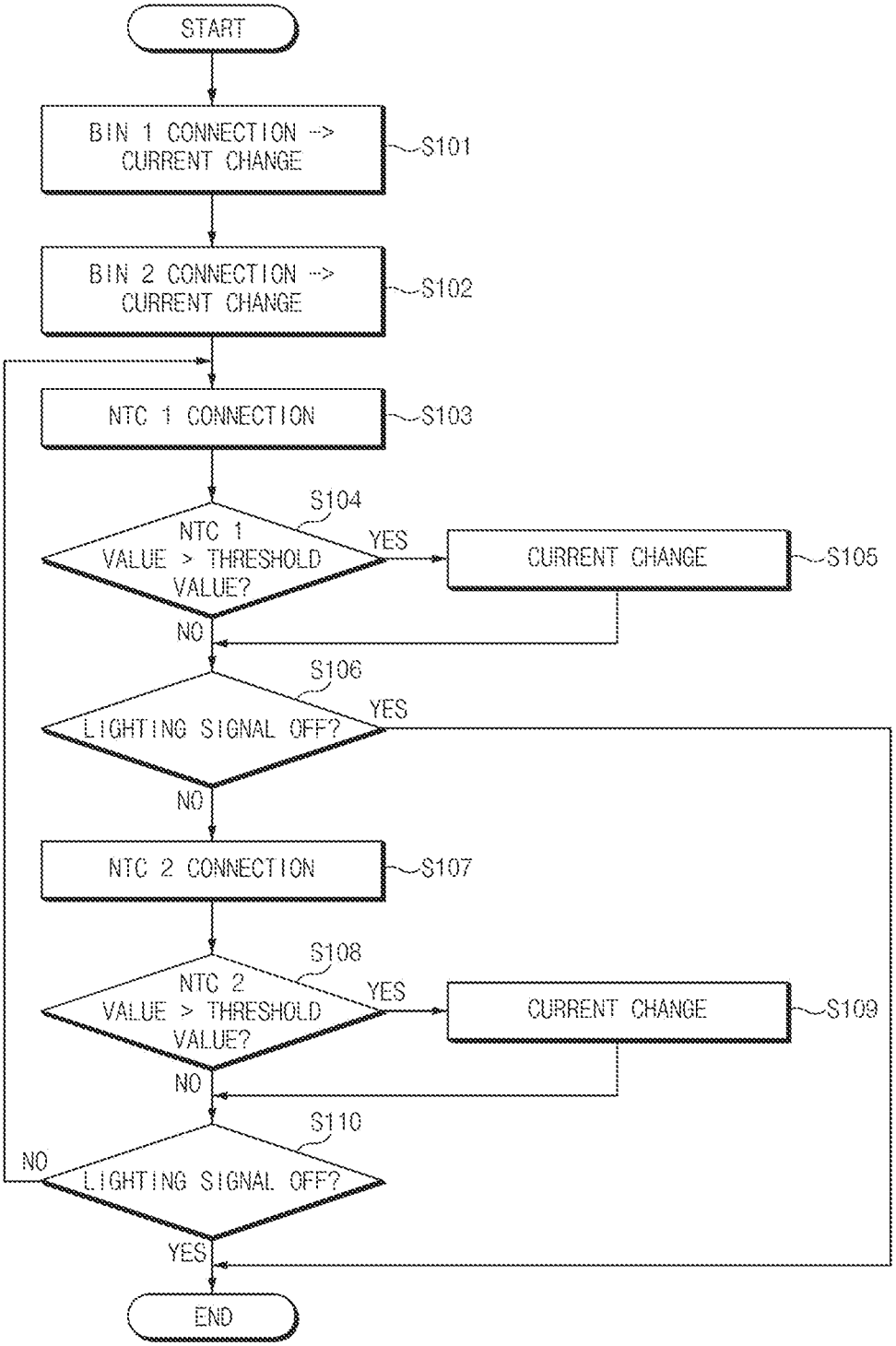
FIG. 8 is a flowchart illustrating a method of controlling a lamp according to the first embodiment of the present disclosure.

FIG. 8 is a flowchart illustrating a method of controlling a lamp according to the first embodiment of the present disclosure. Hereinafter, it is assumed that the apparatus for controlling a lamp of FIG. 1 performs the process of FIG. 8.

First, the LED drive module 300 may drive an LED chip by supplying a driving current set as a default to the LED chip.

Then, in 5101, the LED drive module 300 may share one port to acquire the voltage across both terminals of the first BIN resistor 110 that provides light amount information of the LED chip once, and then may convert the voltage to the current corresponding to the value of the first BIN resistor 110, thereby driving the LED chip.

Then, in 5102, the LED drive module 300 may share one port to acquire the voltage across both terminals of the second BIN resistor 210 that provides light amount information of the LED chip once, and then may convert the voltage to the current corresponding to the value of the second BIN resistor 210, thereby driving the LED chip.

Then, in 5103, the LED drive module 300 may share another port to be connected to the first thermal resistor 130 providing temperature information of the LED chip.

Then, after monitoring the voltage across the first thermal resistor 130, when the voltage attains or exceeds a specified threshold value in 5104, in 5105, the voltage may be converted to the corresponding current, thereby driving the LED chip.

Then, when the vehicle lamp maintains lighting in 5106, the LED drive module 300 may share another port to be connected to the second thermal resistor 230 that provides the temperature information of the LED chip in 5107.

Then, after monitoring the voltage across the second thermal resistor 230, when the voltage attains or exceeds a specified threshold value in 5108, in 5109, the voltage may be converted to the corresponding current, thereby driving the LED chip.

Then, in 5110, after the voltage across the first thermal resistor 130 or the second thermal resistor 230 is alternately monitored until the LED chip is turned off according to the extinguishing of the vehicle lamp, when the voltage attains or exceeds a specified threshold value, the process of driving the LED chip by converting the voltage to the corresponding current may be repeated.

Hereinafter, a second embodiment of the present disclosure will be described in detail with reference to FIGS. 9 to 12.

Figure 9:
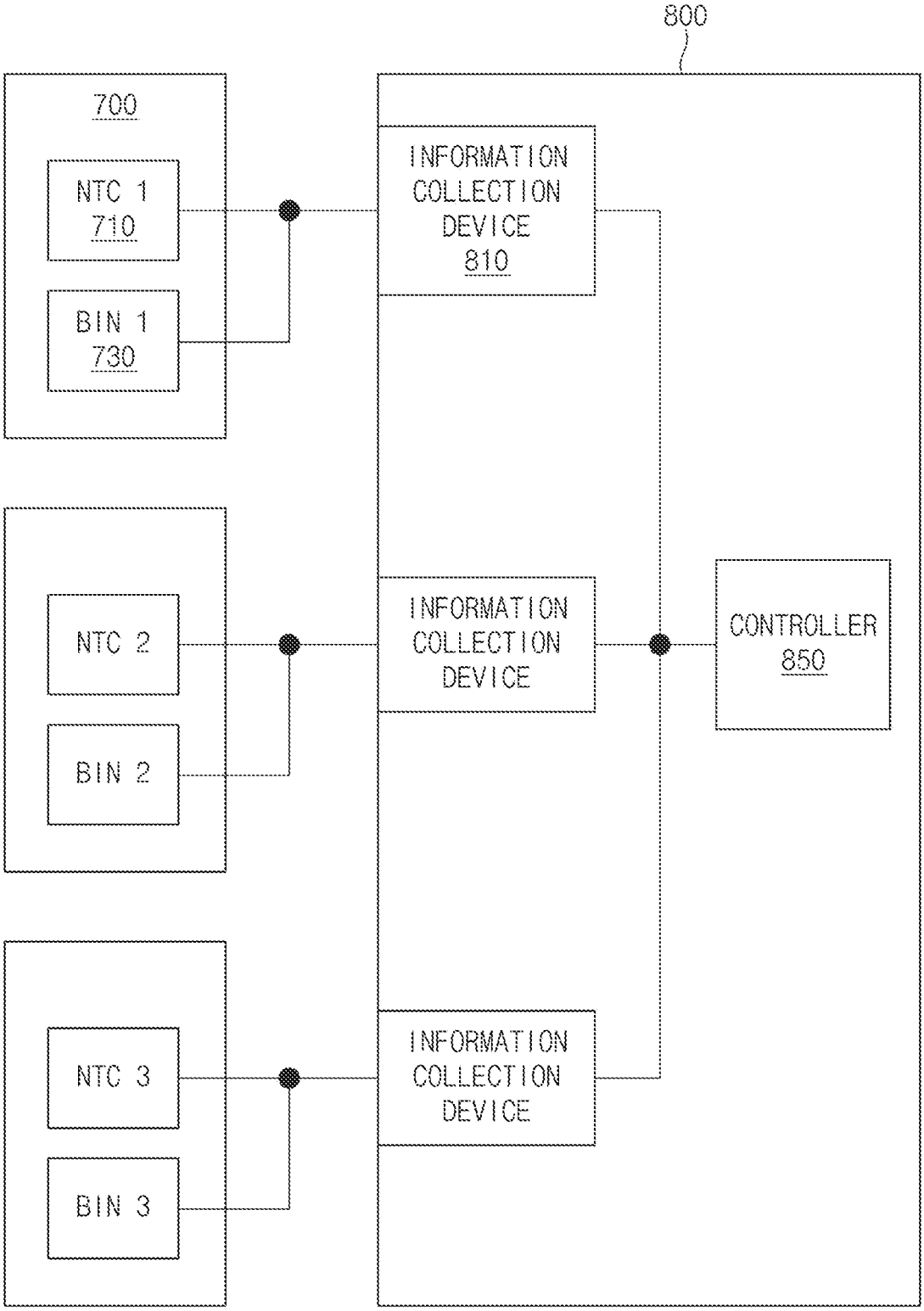
FIG. 9 is a block diagram illustrating an apparatus for controlling a lamp according to a second embodiment of the present disclosure.
Figure 10:
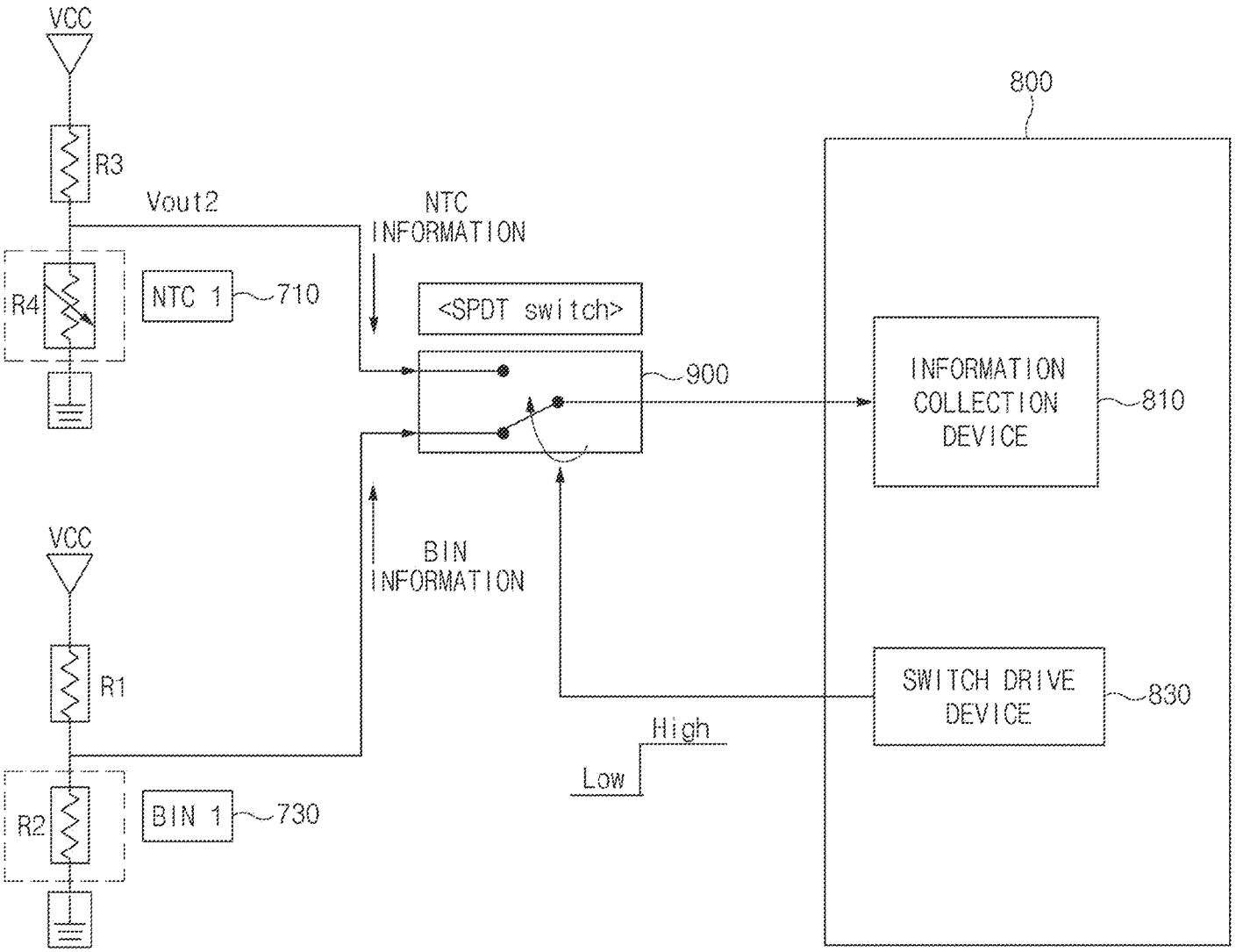
FIGS. 10 and 11 are diagrams illustrating an operation process of an apparatus for controlling a lamp according to the second embodiment of the present disclosure.
Figure 11:
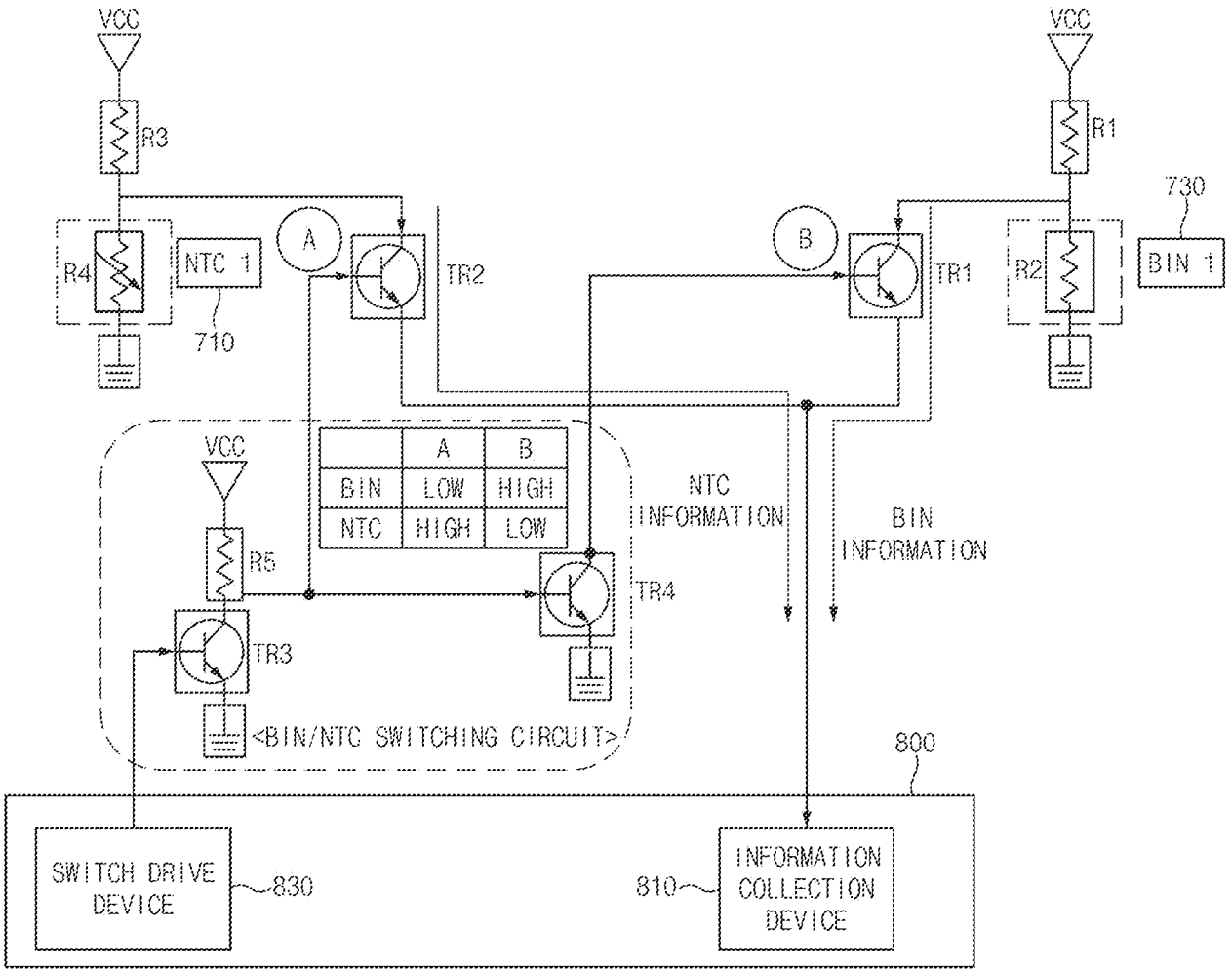

FIG. 9 is a block diagram illustrating an apparatus for controlling a lamp according to a second embodiment of the present disclosure. FIGS. 10 and 11 are diagrams illustrating an operation process of an apparatus for controlling a lamp according to the second embodiment of the present disclosure. FIG. 12 is a view illustrating the use of pins of an MCU through an apparatus for controlling a lamp according to the second embodiment of the present disclosure.

Referring to FIGS. 9 and 10, an apparatus for controlling a lamp according to the second embodiment of the present disclosure may include an LED board 700 and an LED drive module 800.

The LED board 700 may include an LED chip (not shown) serving as a light source, a thermal resistor 710, and a BIN resistor 730.

The LED board 700 may be mounted in plural on a headlamp (low beam lamp and high beam lamp) of a vehicle, a daytime running light (DRL) lamp serving as daytime headlamp, a position lamp serving as a sidelight, a static bending light (SBL) lamp serving as a smart cornering lamp, a turn lamp serving as a turn indicator light, and the like, but the embodiment is not limited thereto.

The BIN resistor 730 may have a resistance value corresponding to a flux BIN of the LED chip, and the LED drive module 800 may drive the LED chip to emit light at a light output power according to the flux BIN.

For reference, it is possible to take a sample of operating features and classify similar LEDs to suggest the cause of the change in the operating features of the LED due to the process change in manufacturing the LED. The flux BIN proposes a reference for classifying LEDs with similar features within an allowable range of light amount, that is, light output power.

For example, a specified reference flux BIN may be set for LEDs outputting 20 to 30 lumen flux at a specified current, and another specified reference flux BIN may be set for LEDs outputting 30 to 40 lumen flux at the same current.

That is, the flux BIN may be defined as information for defining a current, voltage, and the like supplied to LEDs such that the LEDs have a specified light amount.

When the LED drive module 800 obtains the resistance value of the BIN resistor 730, it is possible to know information about the light amount of an LED chip.

The thermal resistor 710 may be an element whose resistance value varies according to the ambient temperature. For example, the thermal resistor 710 may be an NTC thermistor of which resistance decreases as the temperature of an LED chip rises.

When the temperature of the LED chip increases, the amount of light decreases, that is, deterioration may occur as the temperature increases.

Therefore, when the temperature of the LED chip attains or exceeds a specified threshold value through the resistance of the thermal resistor 710, in order to lower the temperature below the specified threshold value, the LED drive module 800 may drive the LED chip while reducing the current.

In addition, the temperature of the LED chip may change frequently depending on the surrounding environment, and accordingly, the resistance value of the thermal resistor 710 may be variably changed, so there may be a need to continuously monitor the resistance value of the thermal resistor 710.

The LED drive module 800 may include an information collection device 810 and a controller 850.

The information collection device 810 may be connected to the BIN resistor 730 or the thermal resistor 710 through one port to receive light amount information and temperature information of the LED chip.

For example, the information collection device 810 may share one ADC port of a MCU to be sequentially connected to the BIN resistor 730 or the thermal resistor 710.

The controller 850 may control the driving current for driving the LED chip based on the light amount information of the LED chip or the temperature information of the LED chip.

Referring to FIG. 10, shown is a circuit in which the first resistor R1 is connected between Vcc and Vout1, and the second resistor R2 is connected between Vout1 and the ground.

The information collection device 810 may obtain Vout1 which is the voltage across both terminals of the second resistor R2.

$$Vout1 = \frac{R4}{R1 + R2} \times Vcc \quad \text{[Equation 5]}$$

Then, the information collection device 810 may obtain the resistance value of the BIN resistor 730 by calculating the resistance value of the second resistor R2 based on Equation 5 which is the voltage division law.

When the resistance value of the BIN resistor 730 is relatively lower than a BIN resistance value providing information about a specified light amount, the current flowing through the LED chip is high to output light with a light amount greater than a specified light amount.

To the contrary, when the resistance value of the BIN resistor 730 is relatively higher than the BIN resistance value providing information about a specified amount of light, the current flowing through the LED chip is low, so that the amount of light lower than the specified amount of light may be output.

A vehicle lamp, for example, a plurality of LED chips constituting a vehicle headlamp should output the same specified amount of light.

Therefore, in order for the plurality of LED chips to output the same specified amount of light, when the LED chip is in a state where an amount of light less than the specified amount of light is output corresponding to the resistance value of the BIN resistor 730, the LED drive module 800 may drive the LED chip to output a specified amount of light by increasing the current.

In order for the plurality of LED chips to output the same specified amount of light, when the LED chip is in a state where an amount of light greater than the specified amount of light is output corresponding to the resistance value of the BIN resistor 730, the LED drive module 800 may drive the LED chip to output a specified amount of light by decreasing the current.

Referring to FIG. 10, shown is a circuit in which the third resistor R3 is connected between Vcc and Vout2, and the fourth resistor R4 is connected between Vout2 and the ground. The information collection device 810 may obtain Vout2 which is the voltage across the fourth resistor R4.

$$Vout2 = \frac{R4}{R3 + R4} \times Vcc \quad \text{[Equation 6]}$$

Then, the information collection device 810 may obtain the resistance value of the thermal resistor 710 by calculating the resistance value of the fourth resistor R4 based on Equation 6 which is the voltage division law.

The LED drive module 800 may detect the temperature of the LED chip based on the resistance value of the thermal resistor 710, and when the temperature attains or exceeds a specified threshold value, the controller 850 may drive the LED chip by changing the current such that a specified amount of light is output.

The LED drive module 800 may detect the temperature of the LED chip based on the resistance value of the thermal resistor 710, and when the temperature attains or exceeds a specified threshold value, the controller 850 may drive the LED chip by changing the current such that a specified amount of light is output.

Meanwhile, because the temperature of the LED chip may change frequently, until the LED chip is turned off according to the extinguishing of the vehicle lamp after the LED chip is turned on according to the driving of the vehicle lamp, the measurement for the thermal resistor 710 may be frequently measured and it is possible to repeatedly monitor whether the temperature attains or exceeds a specified threshold value.

The information collection device 810 may be sequentially connected to the BIN resistor 730 or the thermal resistor 710 through a single pole dual throw (SPDT) switch 900 having one output terminal and two input terminals.

The BIN resistor 730 and the thermal resistor 710 may be connected to the input terminal of the SPDT switch 900, respectively, and the information collection device 810 may be connected to the output terminal of the SPDT switch 900.

A separate switch drive device 830 may output a switch control signal (Low or High) to the SPDT switch 900 to connect the input terminal of the SPDT switch 900 to the BIN resistor 730, thereby obtaining the resistance value of the BIN resistor 730.

For example, the switch drive device 830 may be a general-purpose input/output (GPIO) of the MCU.

In this case, when the resistance value of the BIN resistor 730 is obtained only the first time after the LED chip is turned on according to the driving of the vehicle lamp, the controller 850 may drive the LED chip with the current corresponding to the resistance value of the BIN resistor 730, so that the controller 850 is not connected to the BIN resistor 730 thereafter.

Accordingly, the LED drive module 800 may obtain information on the amount of light of the LED chip corresponding to the resistance value of the BIN resistor 730 first measured once, and the controller 850 may drive the LED chip by changing the current such that a specified amount of light is output.

Then, the switch drive device 830 may output the switch control signal to the SPDT switch 900 to connect the input terminal of the SPDT switch 900 to the thermal resistor 710, thereby obtaining the resistance value of the thermal resistor 710.

Referring to FIG. 11, the SPDT switch 900 function can be replaced by configuring a circuit using a TR (transistor).

First, when a high signal is applied to the base (terminal A) of a first transistor TR1 connected to the BIN resistor 730, and a low signal is applied to the base (terminal B) of a second transistor TR2 connected to the thermal resistor 710, the BIN resistor 730 may be connected to the information collection device 810.

To the contrary, when a low signal is applied to the base (terminal A) of the first transistor TR1 connected to the BIN resistor 730, and a high signal is applied to the base (terminal B) of the second transistor TR2 connected to the thermal resistor 710, the thermal resistor 710 may be connected to the information collection device 810.

In order to apply a high signal or a low signal to the base (terminal A) of the first transistor TR1 and the base (terminal B) of the second transistor TR2, a switching circuit including a third transistor TR3 and a fourth transistor TR4 may be used.

In a circuit where the fifth resistor R5 is connected between Vcc and the bases of the second transistor TR2 and the fourth transistor TR4, and the third transistor TR3 is connected between the fifth resistor R5 and the ground, a switch control signal of the switch drive device 830 may be input to the base of the third transistor TR3.

Accordingly, when a high signal is input to the base of the third transistor TR3, a low signal is input to the base (terminal B) of the second transistor TR2 and the base of the fourth transistor TR4, and a high signal may be input to the base (terminal A) of the first transistor TR1.

To the contrary, when a low signal is input to the base of the third transistor TR3, a high signal may be input to the base (terminal B) of the second transistor TR2 and the base of the fourth transistor TR4, and a low signal may be input to the base (terminal A) of the first transistor TR1.

As described above, without connecting the BIN resistor 730 and the thermal resistor 710 with each individual port of the LED drive module 800, the BIN resistor 730 and the thermal resistor 710 may be sequentially connected to one port, thereby reducing the number of ports used.

For example, referring to FIGS. 9 and 12, although there is required six ports to connect a total of six elements of three BIN resistors BIN1, BIN2, and BINS and three thermal resistors NTC1, NTC2, and NTC3, one port may be shared by sequentially connecting the BIN resistor BIN and the thermal resistor NTC, so that it is possible to connect six elements with only three ports.

Hereinafter, a method of controlling a lamp according to the second embodiment of the present disclosure will be described in detail with reference to FIG. 13.

Figure 13:
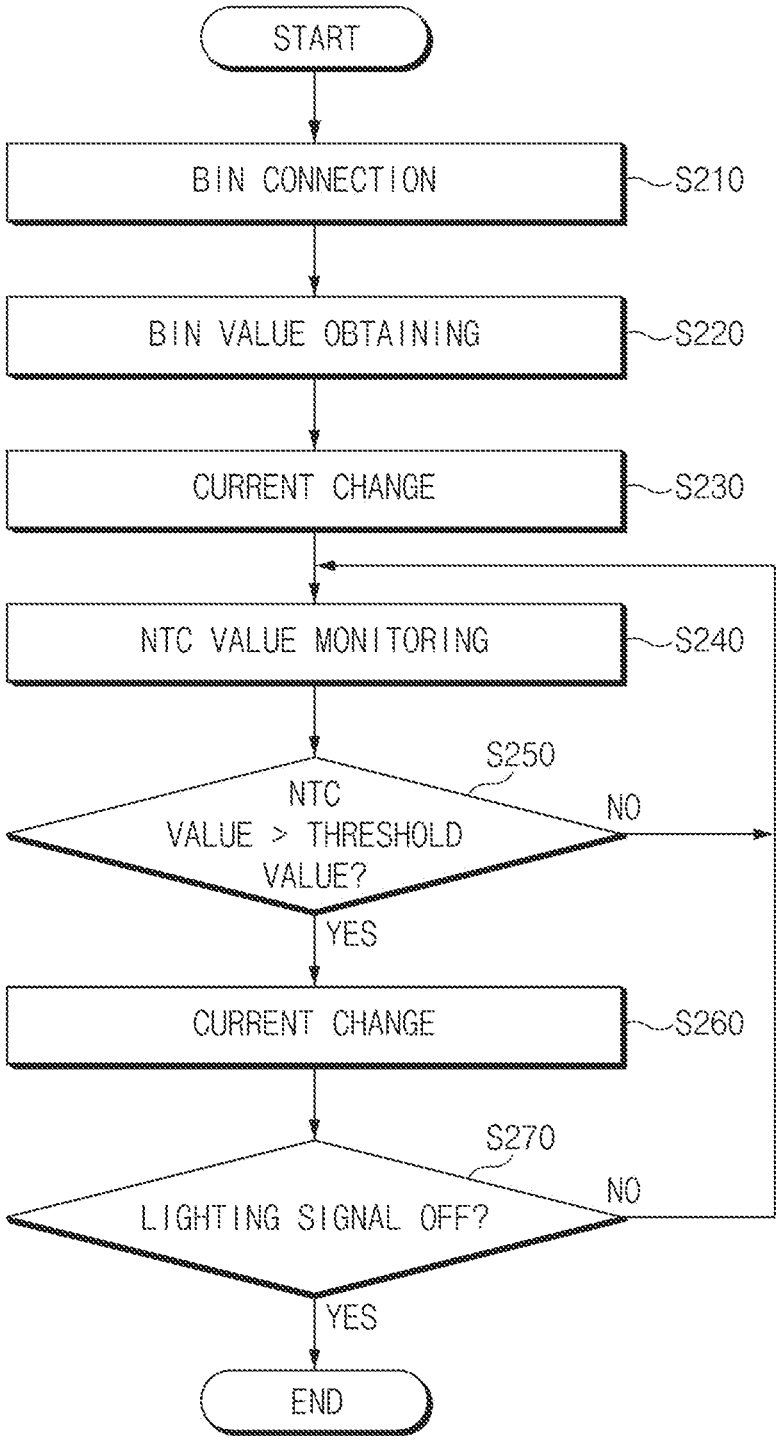
FIG. 13 is a flowchart illustrating a method of controlling a lamp according to the second embodiment of the present disclosure.

FIG. 13 is a flowchart illustrating a method of controlling a lamp according to the second embodiment of the present disclosure. Hereinafter, it is assumed that the apparatus for controlling a lamp of FIG. 9 performs the process of FIG. 13.

First, the LED drive module 800 may drive an LED chip by supplying a driving current set as a default to the LED chip.

Then, in 5210, the LED drive module 800 may be connected to an BIN resistor that provides light amount information of the LED chip by sharing shares one port.

Then, after acquiring the voltage across the BIN resistor once in 5220, in 5230, it is possible to drive the LED chip by changing the current corresponding to the value of the BIN resistor.

Then, in 5240, the LED drive module 800 may share one port to be connected to the thermal resistor providing temperature information of the LED chip.

Then, after monitoring the voltage across the thermal resistor, when the voltage attains or exceeds a specified threshold value in 5250, in 5260, the voltage may be converted to the corresponding current, thereby driving the LED chip.

Then, in 5270, after the voltage across the thermal resistor is monitored until the LED chip is turned off according to the extinguishing of the vehicle lamp, when the voltage attains or exceeds a specified threshold value, the process of driving the LED chip by converting the voltage to the corresponding current may be repeated.

As described above, according to the present disclosure, the present technology may allow BIN resistance data providing light amount information of the LED and NTC sensor data providing temperature information of the LED to be received through one input pin of the LED drive module, thereby reducing the manufacturing cost.

The present technology may allow a plurality of BIN resistance data providing light amount information of the LED to be received through one input pin of the MCU and allow a plurality of NTC sensor data providing temperature information of the LED to be received through another input pin of the MCU, thereby reducing the manufacturing cost.

In addition, various effects that are directly or indirectly understood through the present disclosure may be provided.

The above description is a simple exemplification of the technical spirit of the present disclosure, and the present disclosure may be variously corrected and modified by those skilled in the art to which the present disclosure pertains without departing from the essential features of the present disclosure.

Therefore, the disclosed embodiments of the present disclosure do not limit the technical spirit of the present disclosure but are illustrative, and the scope of the technical spirit of the present disclosure is not limited by the embodiments of the present disclosure. The scope of the present disclosure should be construed by the claims, and it will be understood that all the technical spirits within the equivalent range fall within the scope of the present disclosure.

What is claimed is:

1. An apparatus for controlling a lamp, comprising:

an information collection device configured to receive, from a plurality of LED boards respectively having a plurality of LED chips, light amount information and temperature information of the plurality of LED chips; and a controller configured to control a driving current for driving the plurality of LED chips based on the light amount information or the temperature information of the plurality of LED chips, wherein the information collection device comprises:

a first information collection device having a port and configured to sequentially receive, via the port of the first information collection device, the light amount information of the plurality of LED chips; and a second information collection device having a port and configured to sequentially receive, via the port of the second information collection device, the temperature information of the plurality of LED chips.

2. The apparatus of claim 1, wherein:

the light amount information includes a voltage value across both ends of a BIN resistor included in each of the plurality of LED boards, and the controller is configured to calculate a resistance value of the BIN resistor based on the voltage value and identify a light amount of the LED chip to control the driving current.

3. The apparatus of claim 2, wherein the controller is configured to calculate the resistance value of the BIN resistor based on the voltage value at both ends of the BIN resistor included in each of the plurality of LED boards.

4. The apparatus of claim 1, wherein:

the temperature information includes a voltage value across both ends of a thermal resistor included in each of the plurality of LED boards, and the controller is configured to calculate a resistance value of the thermal resistor based on the voltage value and identify a temperature of the LED chip to control the driving current.

5. The apparatus of claim 4, wherein the thermal resistor includes an NTC thermistor having a resistance decreasing when an ambient temperature rises.

6. The apparatus of claim 4, wherein:

the controller is configured to alternately and repeatedly monitor the voltage value across both ends of the thermal resistor included in each of the plurality of LED boards, and identify the temperature of the LED chip to control the driving current when the temperature of the LED chip attains a threshold value.

7. The apparatus of claim 6, wherein the controller is configured to obtain the voltage value across both ends of the thermal resistor after a stabilization time has lapsed.

8. The apparatus of claim 6, wherein the controller is configured to shorten a period for monitoring the voltage value across both ends of the thermal resistor when the temperature of the LED chip closely approaches the threshold value.

9. A method of controlling a lamp, comprising:

receiving, from a plurality of LED boards respectively including a plurality of LED chips, light amount information and temperature information of the plurality of LED chips; and controlling a driving current for driving the plurality of LED chips based on the light amount information of the LED chip or the temperature information of the plurality of LED chips, wherein receiving the light amount information and the temperature information includes:

sequentially receiving, via a port of a first information collection device, the light amount information of the plurality of LED chips; and sequentially receiving, via a port of a second information collection device, the temperature information of the plurality of LED chips.

10. The method of claim 9, wherein controlling the driving current includes identifying a light amount of the LED chip after calculating a resistance value of a BIN resistor based on the voltage value across both ends of the BIN resistor included in each of the plurality of LED boards.

11. The method of claim 10, wherein controlling the driving current includes calculating the resistance value of the BIN resistor based on the voltage value at both ends of the BIN resistor included in each of the plurality of LED boards.

12. The method of claim 9, wherein receiving the light amount information and the temperature information of the LED chips includes controlling the driving current to identify a temperature of the LED chip after calculating a resistance value of a thermal resistor based on a voltage value across both ends of the thermal resistor included in each of the plurality of LED boards.

13. The method of claim 12, wherein controlling the driving current for driving the LED chip includes:

alternately and repeatedly monitoring the voltage value across both ends of the thermal resistor included in each of the plurality of LED boards; and identifying the temperature of the LED chip to control the driving current when the temperature of the LED chip attains a threshold value.

14. The method of claim 13, wherein controlling the driving current for driving the LED chip includes obtaining the voltage value across both ends of the thermal resistor after a stabilization time has lapsed.

15. The method of claim 13, wherein controlling the driving current for driving the LED chip includes shortening a period for monitoring the voltage value across both ends of the thermal resistor when the temperature of the LED chip closely approaches the threshold value.

* * * * *